US009535379B2

(12) United States Patent
Itoh et al.

(10) Patent No.: US 9,535,379 B2
(45) Date of Patent: Jan. 3, 2017

(54) IMAGE FORMING APPARATUS WITH WARMUP POWER CONTROL AND CONNECTABLE OPTION DEVICE

(71) Applicant: CANON KABUSHIKI KAISHA, Tokyo (JP)

(72) Inventors: Masatoshi Itoh, Mishima (JP); Tetsuya Yamamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/945,653

(22) Filed: Nov. 19, 2015

(65) Prior Publication Data

US 2016/0077472 A1 Mar. 17, 2016

Related U.S. Application Data

(63) Continuation of application No. 14/452,401, filed on Aug. 5, 2014, now Pat. No. 9,223,265.

(30) Foreign Application Priority Data

Aug. 7, 2013 (JP) ..... 2013-163896
Jul. 15, 2014 (JP) ..... 2014-145069

(51) Int. Cl.
*G03G 15/20* (2006.01)
*G03G 21/14* (2006.01)
*G03G 15/00* (2006.01)

(52) U.S. Cl.
CPC ..... *G03G 15/205* (2013.01); *G03G 15/2039* (2013.01); *G03G 15/50* (2013.01);
(Continued)

(58) Field of Classification Search
CPC ..... G03G 15/205
See application file for complete search history.

(56) References Cited

U.S. PATENT DOCUMENTS 7,706,708 B2 * 4/2010 Mori ..... G03G 15/5004 399/69
7,751,742 B2 * 7/2010 Matsudaira ..... G03G 15/5004 399/37

(Continued)

FOREIGN PATENT DOCUMENTS

JP 2001337511 A * 12/2001
JP 2006251729 A * 9/2006

(Continued)

*Primary Examiner* — Minh Phan
*Assistant Examiner* — Leon W Rhodes, Jr.
(74) *Attorney, Agent, or Firm* — Canon U.S.A., Inc. IP Division

(57) ABSTRACT

An image forming apparatus includes an image forming unit, a fixing unit having a heater, a temperature detection unit, a power control unit, and a conveyance control unit that controls conveying a recording material. The conveyance control unit executes, when the maximum power is greater than a threshold power, a first mode where conveyance is performed according to a time, and executes, in a case where the maximum power is less than the threshold power, a second mode where conveyance is performed according to the detected temperature. The power control unit sets a larger value to the threshold power when an option device is connected to the image forming apparatus as compared to when the option device is not connected to the image forming apparatus.

14 Claims, 15 Drawing Sheets

(52) U.S. Cl.
CPC ..... *G03G 2215/00599* (2013.01); *G03G 2215/2035* (2013.01)

(56) References Cited

U.S. PATENT DOCUMENTS 8,073,352 B2 * 12/2011 Kunii ..... G03G 15/5004 399/69
8,340,545 B2 * 12/2012 Suzuki ..... G03G 15/5004 399/37
8,577,242 B2 * 11/2013 Muraishi ..... G03G 15/20 399/374

FOREIGN PATENT DOCUMENTS

JP 2009198599 A * 9/2009
JP 2010249924 A * 11/2010

* cited by examiner

FIG.9

| EXTERNAL OPTION DEVICE | POWER CONSUMPTION |
|---|---|
| AUTOMATIC DOCUMENT FEEDER | 20 W |
| IMAGE SCANNER | 30 W |
| SHEET DISCHARGE OPTION A | 30 W |
| SHEET DISCHARGE OPTION B | 40 W |

IMAGE FORMING APPARATUS WITH WARMUP POWER CONTROL AND CONNECTABLE OPTION DEVICE

CROSS-REFERENCE TO RELATED APPLICATIONS

This application is a continuation of U.S. application Ser. No. 14/452,401, which was filed on Aug. 5, 2014 and which claims priority to Japanese Patent Application No. 2013-163896, which was filed on Aug. 7, 2013, and to Japanese Patent Application No. 2014-145069, which was filed on Jul. 15, 2014, all of which are hereby incorporated by reference.

BACKGROUND

1. Field

Aspects of the present invention generally relate to an image forming apparatus such as a copying machine or a printer which includes a fixing unit.

2. Description of the Related Art

In recent years, there are image forming apparatuses such as the copying machine and the printer which operate at higher speed. Further, there is an increase in color image forming apparatuses, so that power consumption is increasing in portions other than the fixing unit of such image forming apparatuses. On the other hand, the maximum current which can be supplied from a commercial power supply to the image forming apparatus is restricted by a standard. As a result, the power which can be allocated to the fixing unit is decreasing. To solve such a problem, Japanese Patent Application Laid-Open No. 2007-108297 discusses setting timing at which a recording material starts to be conveyed based on warm-up state of the fixing unit, a voltage state of power supply, and an environmental temperature when forming an image. A fixing failure can thus be prevented, and a first print output time (FPOT) can be shortened.

However, if the image forming apparatus operates with an option external device such as an option sheet discharge device or an image scanner connected thereto, the power suppliable to the fixing unit is further reduced. To solve such a problem, when the option external device is connected to the image forming apparatus, the power to be allocated to the fixing unit is previously reduced by an amount of the power required by such an option device to operate. However, if the power to be supplied to the fixing unit is reduced, it becomes necessary to increase a warm-up time of the fixing unit to maintain fixing performance. In such a case, the FPOT becomes long.

SUMMARY OF THE INVENTION

According to an aspect of the present invention, an image forming apparatus, to which an option device is connectable, for forming a toner image on a recording material includes an image forming unit configured to form an unfixed toner image on a recording material, a fixing unit, having a heater, configured to fix the unfixed toner image on a recording material, a temperature detection unit configured to detect a temperature of the fixing unit, a power control unit configured to control power to be supplied to the heater so that the detected temperature becomes a target temperature for enabling fixing the unfixed toner image, and to set a maximum power suppliable to the heater according to a total power to be supplied to the image forming apparatus, and a conveyance control unit configured to control conveyance of a recording material, wherein the conveyance control unit executes, in a case where the maximum power is greater than a threshold power when the heating unit has started to warm up, a first mode where conveyance of a recording material is performed according to a time that has elapsed from when power supply to the heater has started, and executes, in a case where the maximum power is less than the threshold power, a second mode where conveyance of a recording material is performed according to the detected temperature, and wherein the power control unit sets a larger value to the threshold value when the option device is connected to the image forming apparatus as compared to when the option device is not connected to the image forming apparatus.

Further features of the present disclosure will become apparent from the following description of exemplary embodiments with reference to the attached drawings.

BRIEF DESCRIPTION OF THE DRAWINGS

FIG. 9 illustrates an option device power table according to an exemplary embodiment.

DESCRIPTION OF THE EMBODIMENTS

Various exemplary embodiments will be described in detail below with reference to the drawings.

It should be noted that dimensions, materials, shapes, and relative positioning of constituent components described in the following exemplary embodiments are appropriately changeable depending on an actual configuration of an apparatus to which these exemplary embodiments are applied. Therefore, these exemplary embodiments are not seen to limit the scope of the present disclosure.

<Configuration Outline of Image Forming Apparatus>

Figure 1:
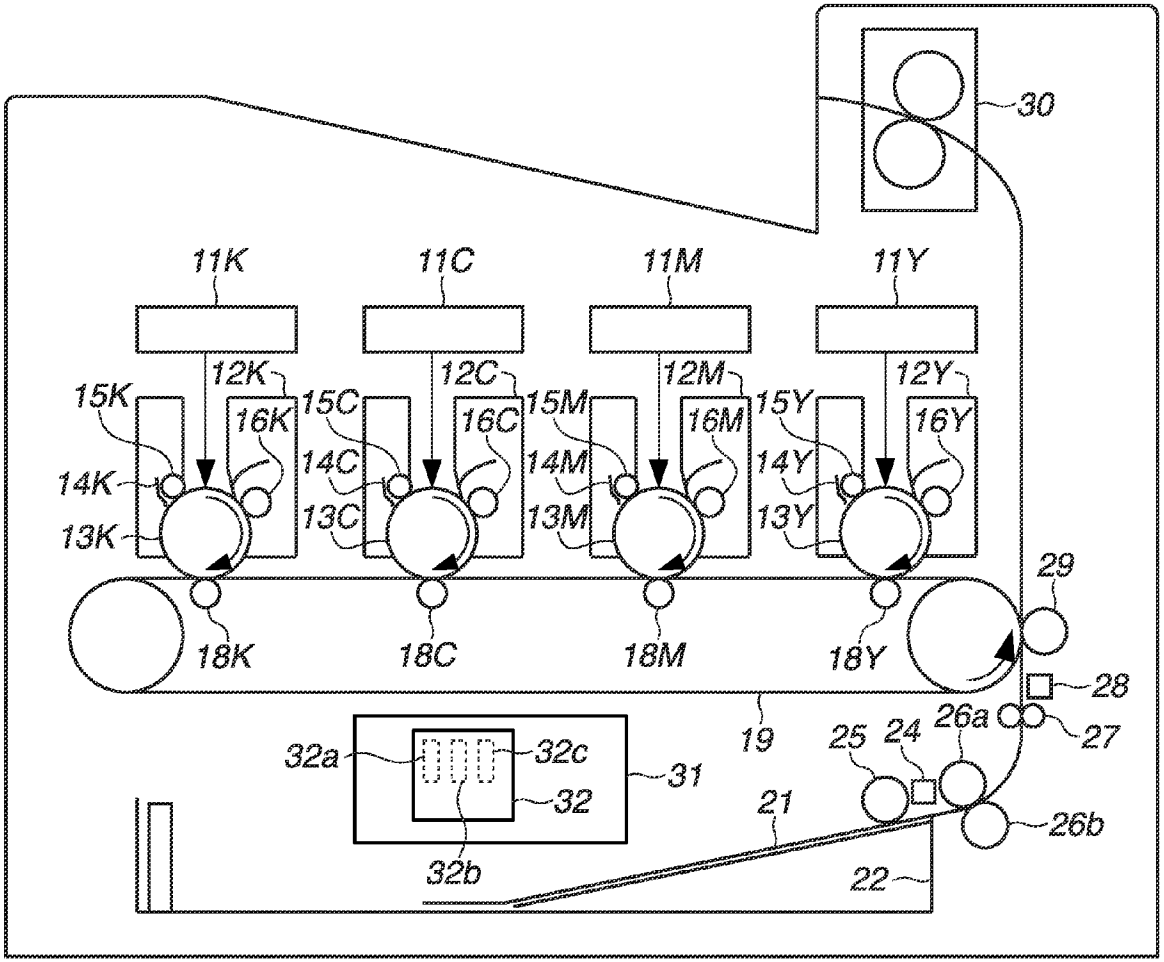
FIG. 1 is a schematic cross-sectional view illustrating an image forming apparatus according to an exemplary embodiment.

FIG. 1 illustrates a configuration of a color image forming apparatus employing an electrophotographic process according to a first exemplary embodiment. Referring to FIG. 1, the image forming apparatus according to the present exemplary embodiment is capable of forming a full-color image by superimposing toner of four colors, i.e., yellow (Y), magenta (M), cyan (C), and black (K). The image forming apparatus includes laser scanners 11Y, 11M, 11C, and 11K as exposure units and cartridges 12Y, 12M, 12C, and 12K for forming an image of each color. The configuration of the cartridges will be described below using the yellow cartridge 12Y. The cartridge 12Y includes a photosensitive drum 13Y, a cleaner 14Y which is a cleaning member of the photosensitive drum 13Y, a charging roller 15Y, i.e., a charging member, and a developing unit having a developing roller 16Y, i.e., a developing member. The photosensitive drum 13Y is an image bearing member which rotates in a direction indicated by an arrow illustrated in FIG. 1. When the image forming apparatus starts an image forming process, the developing roller 16Y which is separated from the photosensitive drum 16Y contacts the photosensitive drum 13Y. The length of time the developing roller 16Y contacts the photosensitive drum 13Y is thus shortened as much as possible to extend lives of the developing roller 16Y and the photosensitive drum 13Y. Since the configurations of the M, C, and K cartridges 12M, 12C, and 12K are similar to that of the Y cartridge 12Y, description will be omitted.

An intermediate transfer belt 19 contacts the photosensitive drums 13Y, 13M, 13C, and 13K. Primary transfer rollers 18Y, 18M, 18C, and 18K are disposed on opposite sides of the photosensitive drums 13Y, 13M, 13C, and 13K sandwiching the intermediate transfer belt 19.

A cassette 22 storing a recording material 21 in a sheet feed unit includes a recording material detection sensor 24 which detects whether there is a recording material therein. Further, a sheet feed roller 25, separation rollers 26*a* and 26*b*, and a registration roller 27 are disposed in a recording material conveyance path. Furthermore, a registration sensor 28 is arranged downstream of the registration roller 27 with respect to a recording member conveyance direction. Moreover, a secondary transfer roller 29 is disposed downstream with respect to the recording member conveyance direction and contacting the intermediate transfer belt 19. Further, a fixing unit 30 is disposed downstream of the secondary transfer roller 29 with respect to the recording member conveyance direction.

A controller 31, i.e., a control unit of the image forming apparatus, includes a CPU 32 having a read-only memory (ROM) 32*a*, a random access memory (RAM) 32*b*, and a timer 32*c*, and various input-output control circuits (not illustrated).

The electrophotographic process will be described below. The processes performed up until the developing process will be described below using the Y cartridge 12Y. The charging roller 15Y uniformly charges a surface of the photosensitive drum 13Y in a dark area inside the cartridge 12Y. The laser scanner 11Y then irradiates the surface of the photosensitive drum 13Y with a laser beam modulated according to image data. A charging potential of the portion irradiated with the laser beam is removed, so that an electrostatic latent image is formed on the surface of the photosensitive drum 13Y. A developing bias is applied in the developing unit, so that the toner on the developing roller 16Y adheres to the electrostatic latent image on the photosensitive drum 13Y to perform development. Such a developing process is performed in each of the cartridges 13M, 13C, and 13K.

A primary transfer bias is applied at a primary transfer portion at which the photosensitive drums 13Y, 13M, 13C, and 13K contact the intermediate transfer belt 19. The toner images formed on the photosensitive drums 13Y, 13M, 13C, and 13K are thus transferred to the intermediate transfer belt 19. Further, the CPU 32 controls image forming timing in each of the cartridges 12Y, 12M, 12C, and 12K according to a conveyance speed of the intermediate transfer belt 19. The CPU 32 thus sequentially transfers each of the toner images to be superimposed on the intermediate transfer belt 19. As a result, the full-color image is formed on the intermediate transfer belt 19.

On the other hand, the sheet feed roller 25 conveys the recording material 21 in the cassette 22, and the separation rollers 26*a* and 26*b* convey the recording material 21 sheet-by-sheet to the secondary transfer roller 29 via the registration roller 27. The toner image on the intermediate transfer belt 19 is transferred to the recording material 21 at a secondary transfer portion at which the secondary transfer roller 29 disposed downstream of the registration roller 27 contacts the intermediate transfer belt 19. According to the present exemplary embodiment, the image forming unit performs the above-described process until transfer of the toner image to the recording material 21. Further, according to the present exemplary embodiment, the registration roller 27 in the image forming apparatus controls conveyance of the recording material 21 so that the recording material 21 reaches the secondary transfer portion at the timing the toner image transferred to the intermediate transfer belt 19 reaches the secondary transfer portion.

The fixing unit 30 then fixes the toner image on the recording material 21, and the recording material 21 is thus discharged to outside the image forming apparatus.

<Configuration of the Fixing Unit>

Figure 2A:
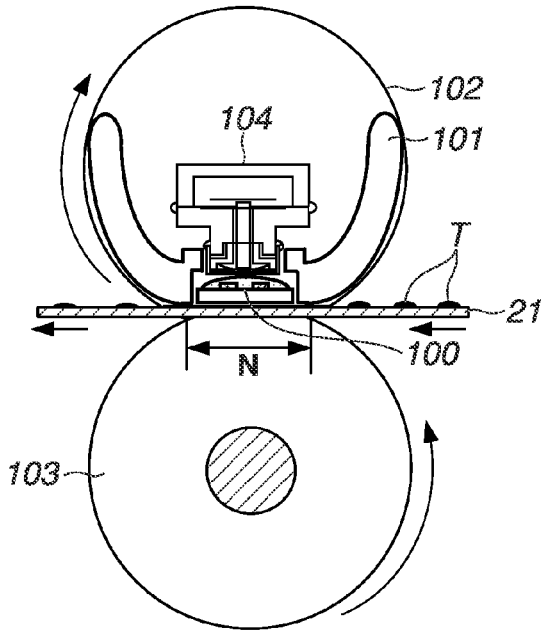
FIGS. 2A, 2B, and 2C illustrate configurations of a fixing unit according to an exemplary embodiment.

FIG. 2A is a schematic cross-sectional view illustrating the fixing unit 30 according to the present exemplary embodiment. Referring to FIG. 2A, the fixing unit 30 includes a cylindrical film 102, a heater 100 contacting an inner surface of the film 102, and a pressing roller 103, i.e., a pressing member, which forms a fixing nip portion N with the heater 100 via the film 102. The fixing unit 30 performs a fixing process at the nip portion N by heating while conveying the recording material carrying the toner image and fixing a toner image T on the recording material. Further, the fixing unit 30 includes a heater holder 101 which holds the heater 100 and guides the inner surface of the film 102, and a temperature detection member 104 arranged so that a thermal surface thereof contacts the surface of the heater 100.

The pressing roller 103 is rotationally driven by a drive source (not illustrated) at a predetermined circumferential speed in a counterclockwise direction indicated by an arrow illustrated in FIG. 2A. The film 102 is rotationally driven along with the pressing roller 103 by a frictional force generated at the fixing nip portion N.

Figure 2B:
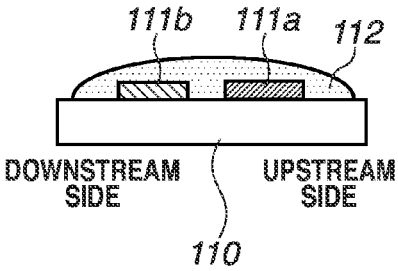

An amount of power to be supplied to the heater 100 is controlled so that the temperature detected by the temperature detection member 104 becomes the target temperature. FIG. 2B is an enlarged cross-sectional view illustrating the heater 100. Referring to FIG. 2B, the heater 100 is a back-surface heating type ceramic heater. The heater 100 includes an insulating substrate 110 formed of ceramics such as silicon carbide (SiC), aluminum nitride (AlN), and alumina (Al203). Further, the heater 100 includes a protective layer 112 such as glass which protects heating resistors 111*a* and 111*b* formed on the substrate 110 by paste printing. Furthermore, a glass layer may be formed on the opposite surface of the surface of the substrate 110 on which the heating resistors 111*a* and 111*b* are formed to improve sliding characteristics.

Figure 2C:
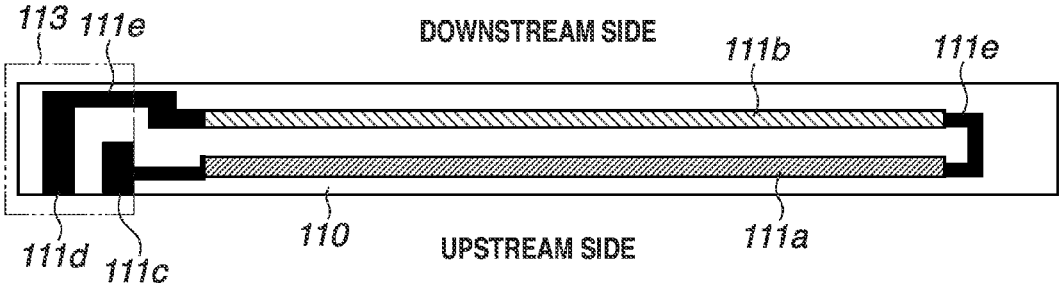

FIG. 2C is a plane view illustrating the heater 100. Referring to FIG. 2C, the heating resistors 111*a* and 111*b*, electrodes 111*c* and 111*d*, and a conductor unit 111*e* are formed on the substrate 110. A terminal (not illustrated) of a power supplying connector 113 contacts the electrodes 111*c* and 111*d*, so that the power is supplied to the heating resistors 111*a* and 111*b* via the conductor unit 111*e*. The heating resistors 111*a* and 111*b* thus generate heat. Further, the power is supplied to the heater 100 via the power supply connector 113.

<A Power Supplying Circuit>

Figure 3:
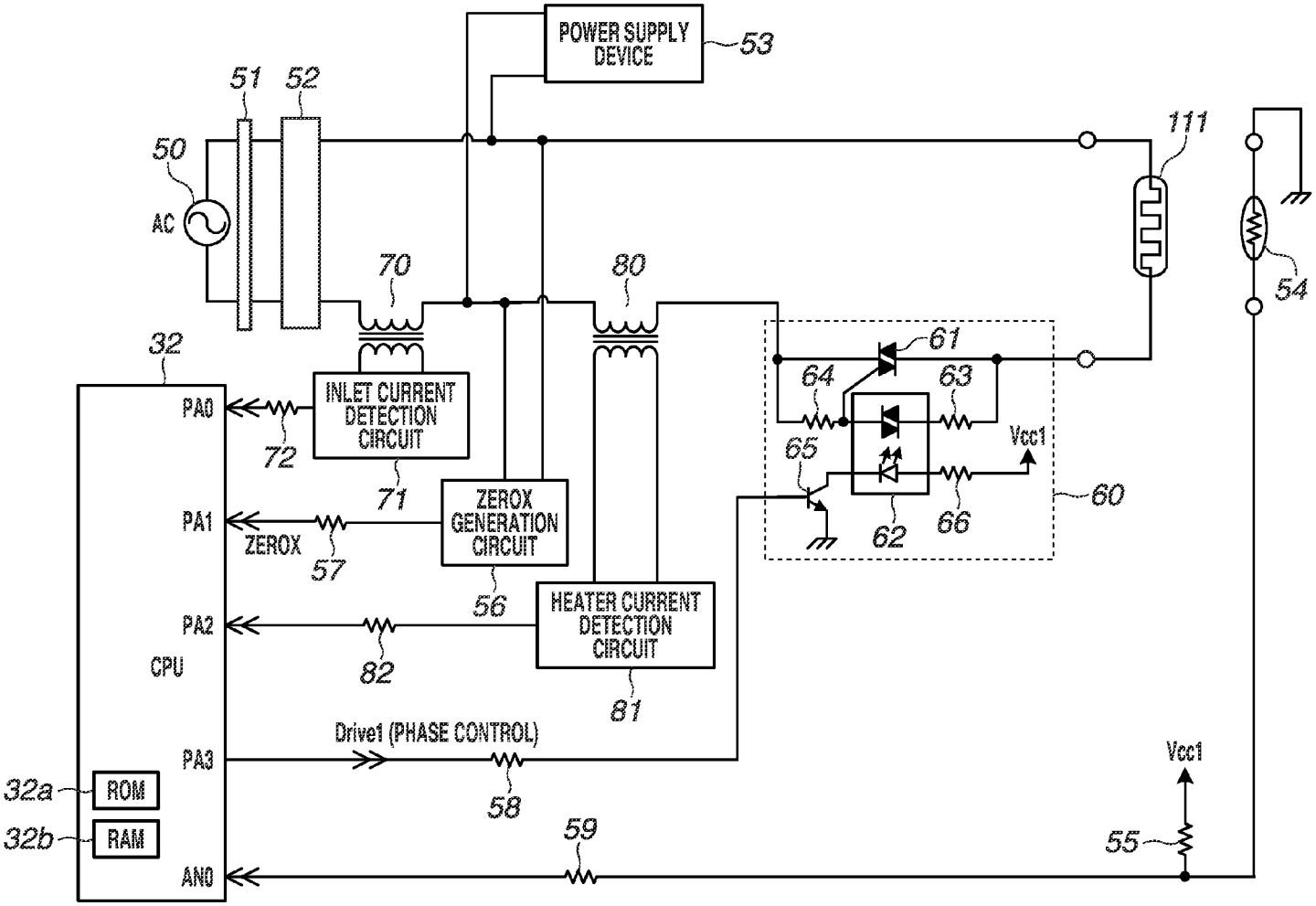
FIG. 3 illustrates a heater driving circuit according to an exemplary embodiment.

FIG. 3 illustrates the power supplying circuit which drives the heater 100 according to the present exemplary embodiment. Referring to FIG. 3, a commercial power supply 50 (i.e., an alternating current (AC) power supply) supplies the AC power to the image forming apparatus from an inlet 51. The power supplying circuit is configured of a primary side connected to the commercial power supply 50 and a secondary side indirectly connected to the primary side. The power input from the commercial power supply 50 is supplied to the heating resistor 111 via an AC filter 52, and causes the heating resistor 111 to generate heat. The power from the commercial power supply 50 is input via the AC filter 52 to a power supply device (i.e. a power supply unit) 53 which then outputs a predetermined voltage to a load in the secondary side. Further, the CPU 32 is also used in performing drive control of the heater 100, and is configured of input-output ports, the ROM 32*a*, and the RAM 32*b*. In other words, the primary side of the power supplying circuit is configured so that the heating resistor 111 in the fixing unit 30 and the power supply device 53 for supplying the power to the secondary side are directly connected to the commercial power supply 50 and supplied with the power. Further, the secondary side of the power supplying circuit is configured so that motors and units that operate in the image forming process, such as the motors that rotate the photosensitive drum and the intermediate transfer belt 19 and the laser scanner, are indirectly connected to the commercial power supply 50 and supplied with the power.

A predetermined amount of power is supplied to the heating resistor 111 from a phase control circuit 60. One end of a temperature detection member 104 arranged on the back surface of the heater 100 is connected to a ground, and the other end to a resistor 55 and an analog input port AN0 in the CPU 32 via a resistor 59. Resistivity of the resistor 59 becomes low as the temperature becomes high. The CPU 32 thus detects the temperature of the heater 100 by dividing the voltage between the temperature detection member 54 and the fixed resistance 55, and converting the voltage to the temperature using a preset temperature table (not illustrated).

On the other hand, the power from the commercial power supply 50 is input to a zero-cross (zerox) generation circuit 56. The zerox generation circuit 56 outputs a high-level signal when a commercial power supply voltage is less than or equal to a threshold voltage near 0 V, and outputs a low-level signal in other cases. A pulse signal of approximately the same period as the period of the commercial power supply voltage is then input to a port PA1 in the CPU 32 via a resistor 57. The CPU 32 detects an edge at which the zerox signal changes from high-level to low-level, and uses the detected edge in controlling the timing in performing phase control and switching control.

The CPU 32 determines lighting timing for driving the phase control circuit 60 based on the detected temperature, and outputs a drive signal from a port PA3. The phase control circuit 60 will be described below. When the signal output from the output port PA3 becomes high-level at predetermined lighting timing, a transistor 65 is switched on via a base resistor 58. As a result, a phototriac coupler 62 is switched on. The phototriac coupler 62 is a device for maintaining a creeping distance between the primary side and the secondary side. Further, a resistor 66 limits the current flowing in a light-emitting diode in the phototriac coupler 62.

Resistors 63 and 64 are bias resistors for a triac 61, and the triac 61 becomes energized when the phototriac coupler 62 is switched on. When an ON trigger is applied while the AC is supplied to the triac 61, the triac 61 is maintained in the energized state until the AC is not supplied thereto. The power is thus supplied to the heating resistor 111 according to the timing the triac 61 is triggered on.

Further, a sum of the current supplied to the power supply device 53 from the commercial power supply 50 via the AC filter 52 and the current supplied to the heating resistor 111 become the current supplied to the inlet 51, and are input to an inlet current detection circuit 71 via a current transformer 70. The inlet current detection circuit (i.e., a detection unit) 71 performs voltage conversion on the input current. A current detection signal which has been voltage-converted is then input to the PA0 in the CPU 32 via a resistor 72, analog/digital (A/D)-converted, and managed as a digital value.

The current supplied to the heating resistor 111 is similarly input to a heater current detection circuit 81 (i.e., a current detection unit) via a current transformer 80. The heater current detection circuit 81 performs voltage conversion on the input current. The current detection signal which has been voltage-converted is input to the PA2 in the CPU 32 via a resistor 82, A/D-converted, and managed as the digital value.

<The Current Detection Circuit of the Heater>

Figure 4:
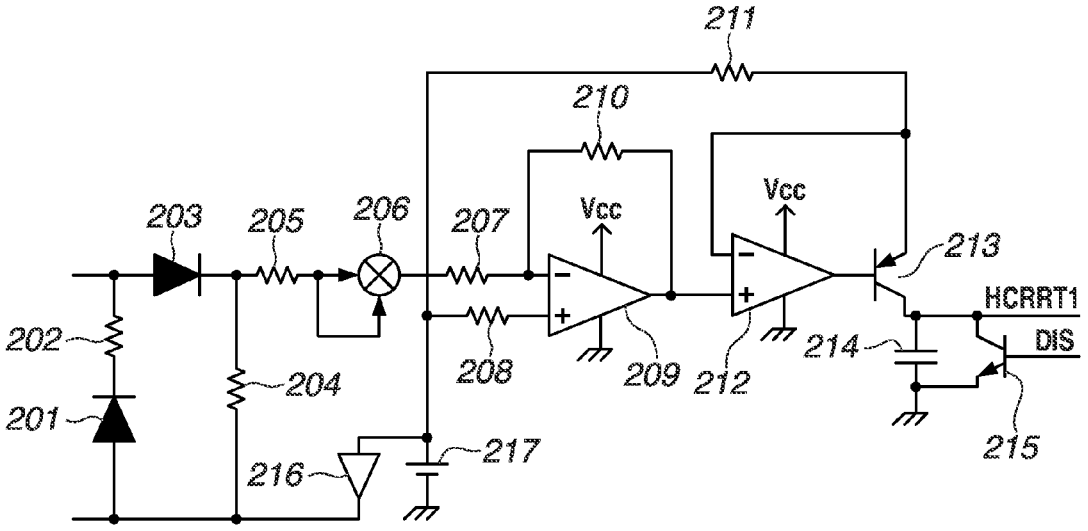
FIG. 4 illustrates a heater current detection circuit according to an exemplary embodiment.
Figure 5:
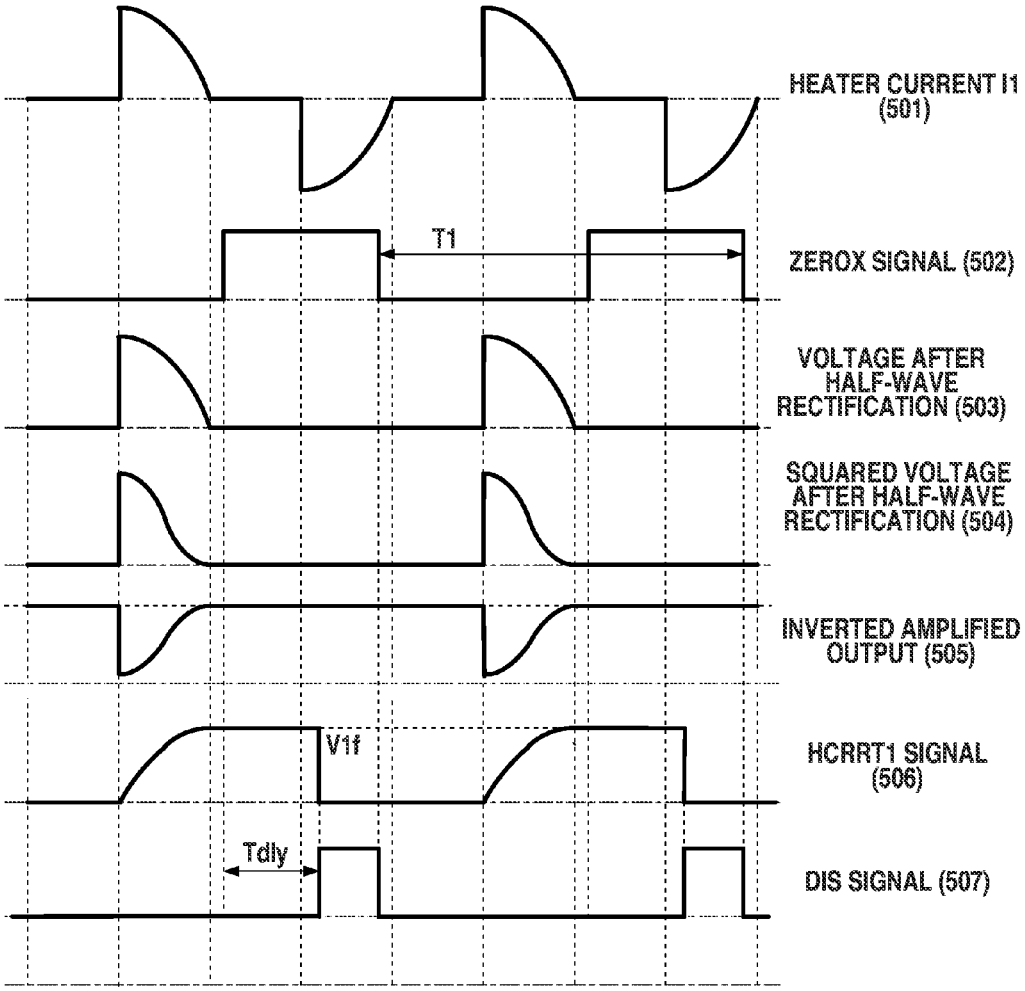
FIG. 5 illustrates an operation of the heater current detection circuit according to an exemplary embodiment.

FIG. 4 is a block diagram illustrating the configuration of the heater current detection circuit 81 according to the present exemplary embodiment. FIG. 5 is a waveform diagram illustrating the operation of the heater current detection circuit 81 according to the present exemplary embodiment.

Referring to FIG. 5, a waveform 501 indicates a heater current I1 flowing in the heating resistor 111. The current waveform of the heater current I1 is voltage-converted by the current transformer 80 in the secondary side. Diodes 201 and 203 illustrated in FIG. 4 rectify the voltage output of the current transformer 80, and resistors 202 and 205 are connected thereto as load resistors. A waveform 503 indicates the waveform on which half-wave rectification has been formed by the diode 203. The voltage waveform is then input to a multiplier 206 via a resistor 205. The multiplier 206 then outputs a squared voltage waveform as indicated by a waveform 504. The squared waveform is input to a minus terminal of an operational amplifier 209. A reference voltage 217 is input to a plus terminal of the operational amplifier 209 via a resistor 208, so that the squared waveform is inverted and amplified by a feedback resistor 210. The operation amplifier 209 is supplied with the power from either one end of the power supply.

A waveform 505 indicates the waveform which has been inverted and amplified based on the reference voltage 217. The output from the operation amplifier 209 is input to the plus terminal of an operational amplifier 212. The operational amplifier 212 controls a transistor 213 so that the current determined by a voltage difference between the reference voltage 217 and the waveform input to the plus terminal thereof and a resistor 211 flows into a condenser 214. The condenser 214 is thus charged by the current determined by voltage difference between the reference voltage 217 and the waveform input to the plus terminal thereof, and the resistor 211.

When the diode 203 ends performing the half-wave rectification, the charging current stops flowing into the condenser 214, so that a voltage value thereof is peak-held. A digital identification signal (DIS) then switches on the transistor 215 while the diode 201 is performing the half-wave rectification as indicated by a waveform 507. As a result, a charging voltage of the condenser 214 is discharged. The DIS signal output from the CPU 32 switches on and off the transistor 215, and performs on-off control of the transistor 215 based on a ZEROX signal indicated by a waveform 502. The DIS signal switches on the transistor 215 after a predetermined time Tdly has elapsed from a rising edge of the ZEROX signal and switches off the transistor 215 at the same timing as or immediately before a falling edge of the ZEROX signal. As a result, control can be performed without interfering with an energizing period of the fixing heater 100 which is the half-wave rectification period of the diode 201.

In other words, a peak-hold voltage V1*f* of the condenser 214 becomes an integrated value of a half period of the squared value of the waveform obtained by the current transformer 80 performing voltage-conversion of the current waveform in the secondary side. The voltage value which has been peak-held by the condenser 214 is thus transmitted to the CPU 32 from the heater current detection circuit 81 as an HCRRT1 signal 506. The CPU 32 performs A/D conversion of the HCRRT1 signal until the predetermined time Tdly elapses from the rising edge of the ZEROX signal 502. The heater current I1 which has been A/D-converted becomes the heater current I1 corresponding to one whole wave of the commercial power supply voltage. The CPU 32 then averages the heater current I1 corresponding to four whole waves of the commercial power supply voltage, multiplies the averaged result by a previously provided coefficient, and calculates the power consumed by the heating resistor 111. The current detection method of the heater current I1 is not limited to the above-described method.

<The Inlet Current Detection Circuit>

Figure 6:
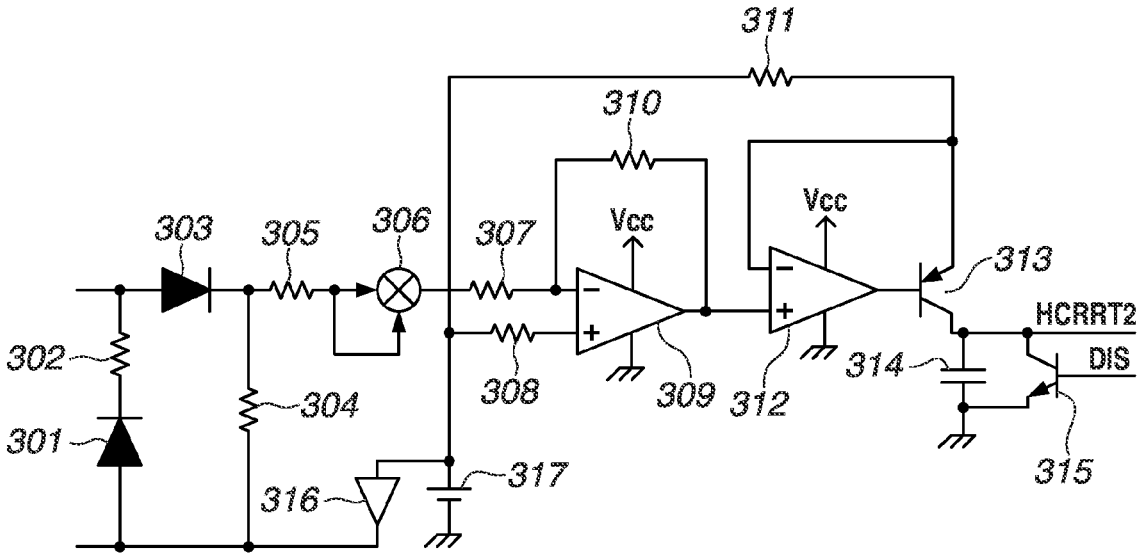
FIG. 6 illustrates an inlet current detection circuit according to an exemplary embodiment.
Figure 7:
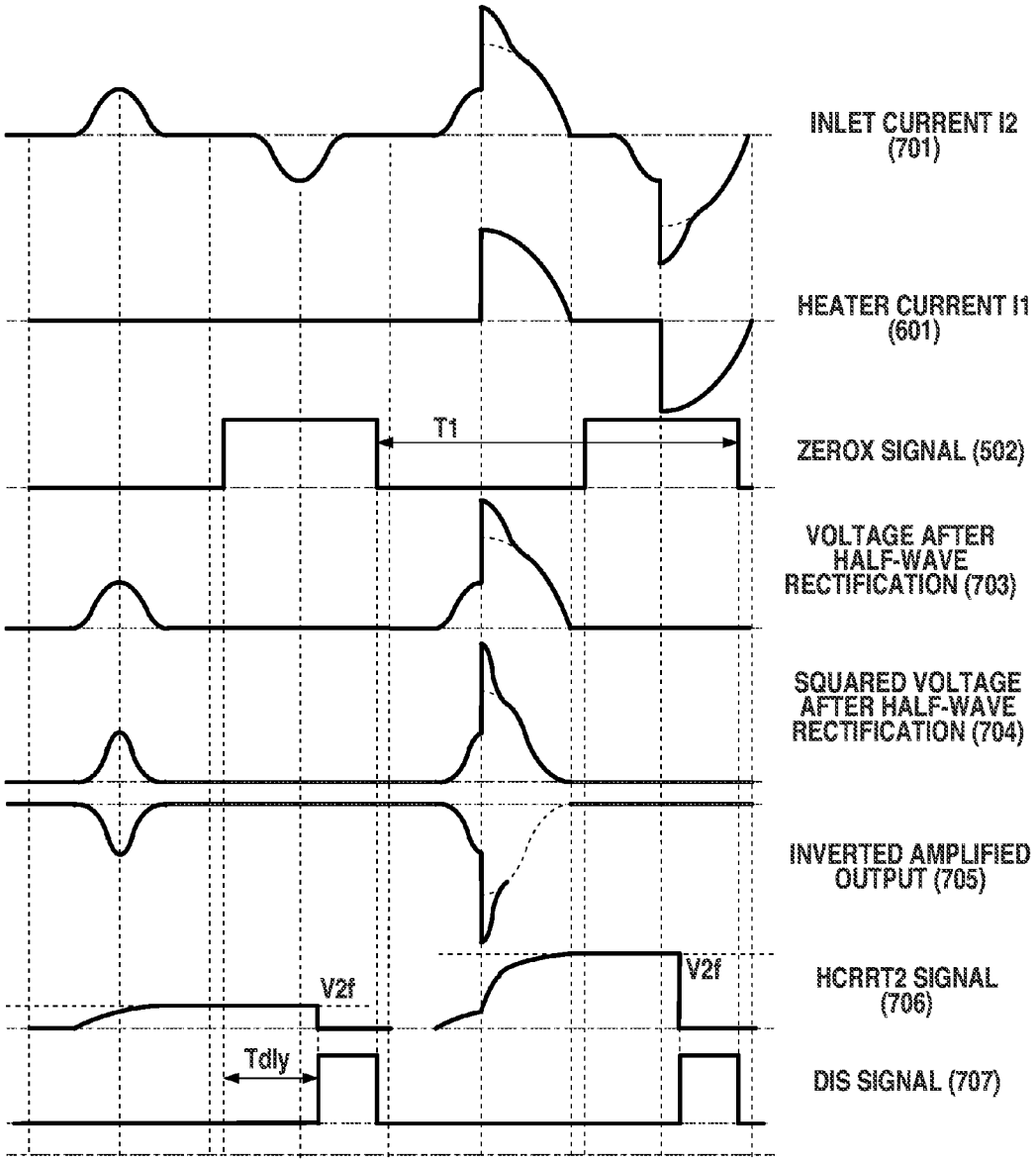
FIG. 7 illustrates an operation of the inlet current detection circuit according to an exemplary embodiment.

FIG. 6 is a block diagram illustrating the configuration of the inlet current detection circuit 71 according to the present exemplary embodiment. FIG. 7 is a waveform diagram illustrating the operation of the inlet current detection circuit 71 according to the present exemplary embodiment.

Referring to FIG. 7, a waveform 701 indicates an inlet current I2 supplied via the inlet 51 and the AC filter 52. The inlet current I2 is voltage-converted by the current transformer 70 in the secondary side. The inlet current I2 is a sum of the current I1 501 illustrated in FIG. 5 supplied to the heating resistor 111 and a current I3 flowing in the power supply device 53.

Diodes 301 and 303 illustrated in FIG. 6 rectify the voltage output from the current transformer 70, and resistors 302 and 305 are connected thereto as the load resistors. A waveform 703 indicates the voltage waveform on which the diode 303 has performed the half-wave rectification. The voltage waveform is then input to a multiplier 306 via the resistor 305. The multiplier 306 outputs the squared waveform as indicated by a waveform 704. The squared waveform 704 is input to the minus terminal of an operational amplifier 309. A reference voltage 317 is input to the plus terminal of the operational amplifier 309 via resistor 308, so that the squared waveform 704 is inverted and amplified by a feedback resistor 310. The operation amplifier 309 is supplied with the power from either one end of the power supply. The waveform which has been inverted and amplified based on the reference voltage 317, i.e., an output 705 from the operation amplifier 309, is input to the plus terminal of an operational amplifier 312.

The operational amplifier 312 controls a transistor 313 so that the current determined by the voltage difference between the reference voltage 317 and the waveform input to the plus terminal thereof, and a resistor 311 flows into a condenser 314. The condenser 314 is thus charged by the current determined by the voltage difference between the reference voltage 317 and the waveform input to the plus terminal thereof and the resistor 311. When the diode 203 ends performing the half-wave rectification, the charging current stops flowing into the condenser 314, so that the voltage value thereof is peak-held, as indicated by a waveform 706. If a transistor 315 is then switched on while the diode 301 is performing the half-wave rectification, the voltage charged in the condenser 314 is discharged. The transistor 315 is switched on and off by the DIS signal from the CPU 32 and is controlled based on the ZEROX signal indicated by the waveform 502. The DIS signal is switched on after the predetermined time Tdly has elapsed from the rising edge of the ZEROX signal and is switched off at the same timing as or immediately before the falling edge of the ZEROX signal. As a result, control can be performed without interfering with the period the current flows in the heater 100 which is the half-wave rectification period of the diode 303.

In other words, a peak-hold voltage V2*f* of the condenser 314 becomes the integrated value of the half period of the squared value of the waveform obtained by the current transformer 70 performing voltage conversion on the current waveform in the secondary side. The voltage value which has been peak-held by the condenser 314 is thus transmitted to the CPU 32 from the inlet current detection circuit 71 as an HCRRT2 signal 706. The CPU 32 performs A/D conversion of the HCRRT2 signal 706 within the predetermined time Tdly from the rising edge of a ZEROX signal 701 input from the port PA0. The inlet current I2 which has been A/D-converted becomes the inlet current I2 corresponding to one whole wave of the commercial power supply voltage. The CPU 32 then averages the inlet current corresponding to four whole waves of the commercial power supply voltage, multiplies the averaged by a previously provided coefficient, and calculates the power consumed by the entire image forming apparatus. The current detection method of the heater current I2 is not limited to the above-described method. 6<Connection of the CPU 32 to the Option Devices>

Figure 8:
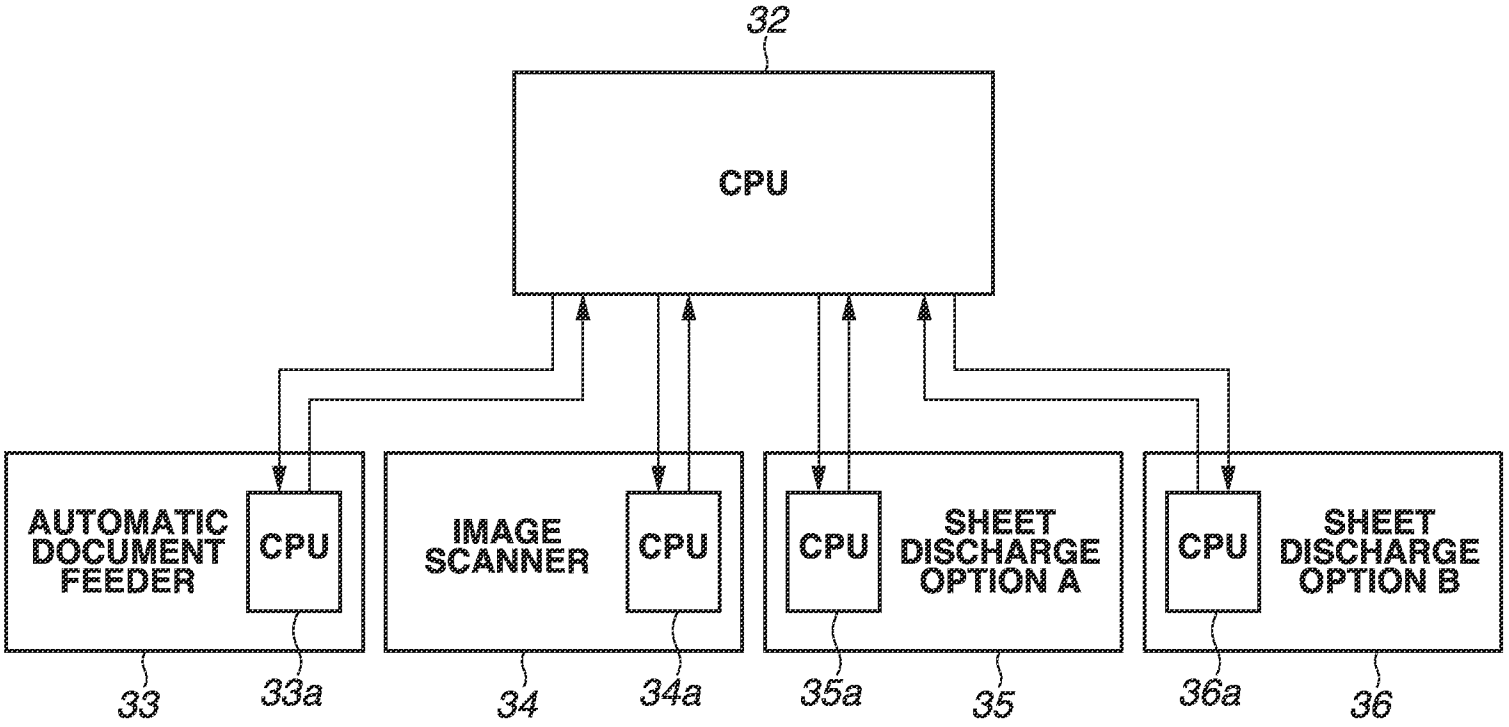
FIG. 8 illustrates connection of a central processing unit (CPU) to option devices according to an exemplary embodiment.

FIG. 8 illustrates the connection of the CPU 32 to the external option devices according to the present exemplary embodiment. According to the present exemplary embodiment, an automatic document feeder 33, an image scanner 34, a sheet discharge option A 35, and a sheet discharge option B 36 are used as the external option devices. The method for connecting the image forming apparatus to each of the external option devices will be described below with reference to FIG. 8. The image forming apparatus is connected to the automatic document feeder 33, the image scanner 34, the sheet discharge option A 35, and the sheet discharge option B 36 which respectively include CPU 33*a*, 34*a*, 35*a*, and 36*a*. The CPU 32 is connected to each of the CPU 33*a*, 34*a*, 35*b*, and 36*a* so that the signals can be mutually input and output. The CPU 32 communicates with each of the CPU 33*a*, 34*a*, 35*b*, and 36*a* to detect types and the number of the external option devices connected to the image forming apparatus.

FIG. 9 illustrates a table indicating the power consumed when each of the external option devices is operating. Referring to FIG. 9, a user determines the external option devices which is to be connected to the image forming apparatus. As a result, the power necessary for the image forming apparatus to allocate to the operation of the external option device becomes different depending on the number and the types of the connected external option devices.

According to the present exemplary embodiment, the external option device is not limited thereto as long as the device is externally connected to the image forming apparatus.

According to the present exemplary embodiment, when the image forming apparatus is turned on, the number and the types of the connected external option devices are detected. A consumed power Po by the operation of the detected external option device is then calculated using the power table of the external option devices which is previously provided as illustrated in FIG. 9. For example, if the automatic document feeder 33, the image scanner 34, the sheet discharge option A 35, and the sheet discharge option B 36 are connected to the image forming apparatus, a maximum consumed power Po by the operations of the external option devices is calculated as 20 W+30 W+30 W+40 W=120 W.

Figure 14:
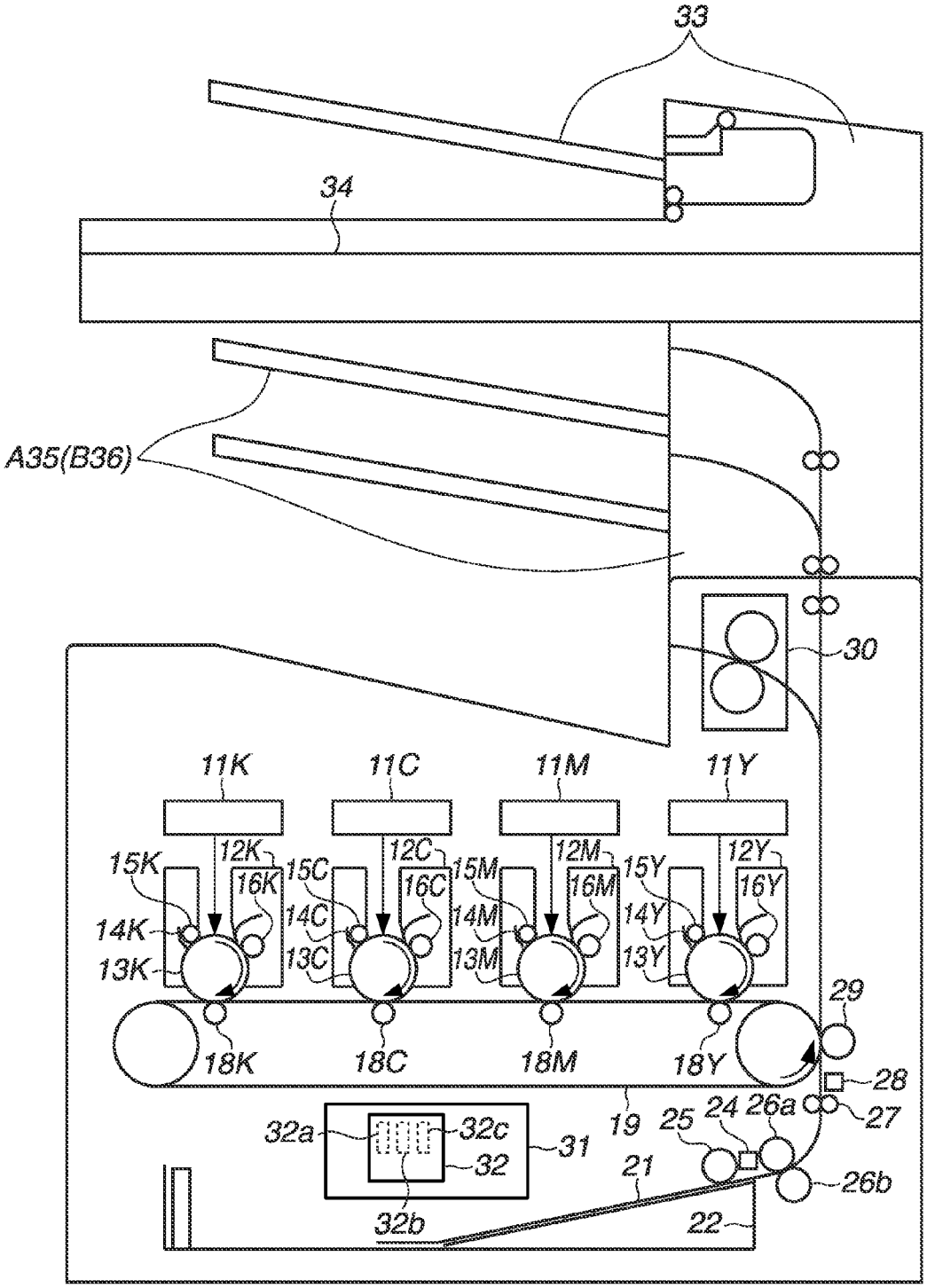
FIG. 14 illustrates an option device according to the first exemplary embodiment.

Functions of the image scanner 34, the automatic document feeder 33, the sheet discharge option A 35, and the sheet discharge option B 36 will be described below with reference to FIG. 14. Referring to FIG. 14, the image scanner 34 scans and reads a document mounted on a document stage using a reading unit (not illustrated) which moves along a guide rail. The image forming apparatus can then perform the image forming process on the read document and copy the document. Further, the automatic document feeder 33, i.e., an automatic document feeding device, automatically feeds the preset document sheet-by-sheet to the document stage of the image scanner 34. After the document has been read, the automatic document feeder 33 automatically discharges the document. A plurality of documents can be automatically scanned and read by the image scanner 34 using the automatic document feeder 33. Further, the sheet discharge options A 35 and B 36 are capable of sorting out each job and outputting the recording materials output from the fixing unit of the image forming apparatus. Further, there are sheet discharge options capable of performing post-processing of the document, such as stapling, bookbinding, and cutting. The sheet discharge option B 36 consumes greater power as compared to the sheet discharge option A 35.

According to the present exemplary embodiment, the maximum consumed power is calculated by assuming that there is a case where the connected external option devices operate at the same time. However, if there are external option devices which do not operate at the same timing, the maximum consumed power is calculated by considering such devices.

<Warm-Up>

The method for calculating power Pf_max suppliable to a heater and limiting the power when performing control according to the present exemplary embodiment will be described below with reference to FIGS. 10A and 10B. The warm-up of the fixing unit from the state where the temperature of the fixing unit is lowered to the environmental temperature, i.e., from a cold state, will be described below.

The present exemplary embodiment is also applicable to warm-up processing of the fixing unit from the state where the image forming apparatus is performing preheating in a stand-by mode, or an initial warm-up after the power has been turned on.

Figure 10A:
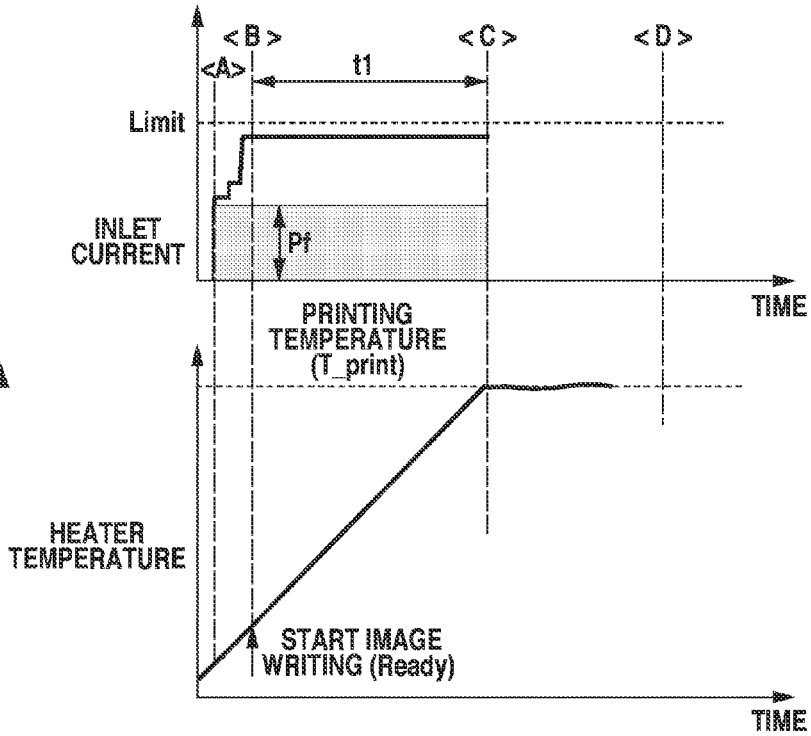
FIGS. 10A and 10B illustrate a warm-up process according to a first exemplary embodiment.

FIG. 10A illustrates a case where the inlet current I2 becomes less than or equal to a predetermined current when performing normal warm-up control of the fixing unit. FIG. 10B illustrates the case where the inlet current I2 has become greater than or equal to the predetermined current I1 and the heater current I1 has been limited. Graphs illustrated in upper portions of FIGS. 10A and 10B respectively indicate temporal transitions of the inlet current I2 and the heater current I1 from when the warm-up of the fixing unit has started, and the graphs illustrated in lower portions indicate the transition of the temperature of the fixing heater 100.

Referring to FIG. 10A, when the image forming apparatus receives an instruction to start the warm-up, the image forming apparatus starts supplying predetermined power (Pf) to the fixing unit 30 at timing A. Further, the image forming apparatus starts driving a motor for driving the fixing unit 30. The image forming apparatus then sequentially activates the loads related to the image forming process, such as a polygon motor and the motor which drives the photosensitive drum, during a period between the timing A and timing B illustrated in FIG. 10A. The predetermine power Pf is the power which is to be supplied to the heater 100 for the fixing unit to warm up so that the FPOT becomes the shortest, and is the predetermined power. In other words, the predetermined power Pf is supplied to the heater 100 from the start timing of the image forming process to when the recording material 21 reaches the fixing nip portion N. As a result, the temperature of the heater 100 rises to a temperature T_print at which the fixing process can be performed. According to the present exemplary embodiment, when a Ready signal of the fixing unit 30 is output, the image forming process is started. According to the present exemplary embodiment, the image forming process started after the Ready signal has been output is a developing unit abutting, feeding of the recording material, and image writing. However, it is not limited thereto.

When the image forming apparatus completes activating all loads at the timing B, the CPU 32 monitors the inlet current I2 and confirms whether the inlet current I2 is greater than a preset current limit Ilim. If the inlet current I2 does not exceed the current limit Ilim as illustrated in FIG. 10A, the CPU 32 calculates power Pf_max suppliable the heater which has been increased by a current difference with respect to the current limit Ilim. According to the present exemplary embodiment, the current limit Ilim is a current value which has been preset to 15 A or less. There is a limit to the power suppliable to the fixing unit 30 depending on a relation between an electrical resistance value of the heater 100 and the input AC voltage even if the power has been fully supplied to the heater 100. The power Pf_max suppliable to the heater calculated according to the present exemplary embodiment is calculated by considering a supply power limit based on the relation between the electrical resistance value and the input AC voltage. If the power Pf_max suppliable to the heater is greater than a predetermined Ready power Pth at the timing B, the image forming apparatus immediately starts writing the image. On the other hand, if the power Pf_max suppliable to the heater is less than the Ready power Pth, the image forming apparatus starts writing the image at the timing the detected temperature of the heater 100 has reached a threshold temperature which is lower than the target temperature of the heater 100 performing the fixing process. According to the present exemplary embodiment, the threshold temperature is set to T_print −30 (° C.).

Figure 10B:
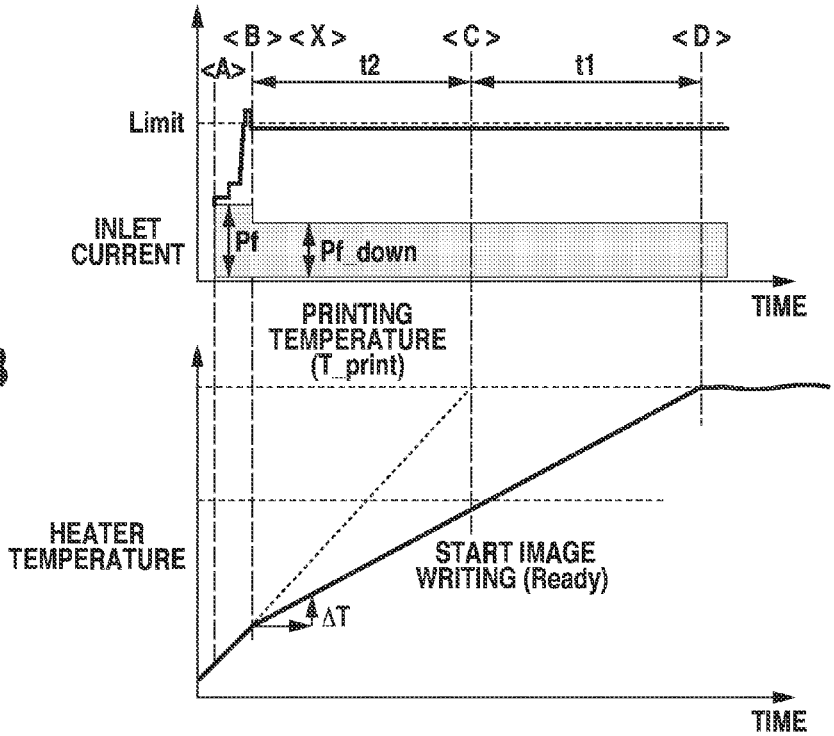

Referring to FIG. 10B, when the image forming apparatus receives an instruction to start the warm-up of the heater 30, the image forming apparatus starts supplying the predetermined power Pf to the fixing unit 30 at the timing A. Further, the image forming apparatus starts driving the motor for driving the fixing unit 30. The image forming apparatus then sequentially activates all of the loads related to the image forming process, such as the polygon motor and the motor which drives the photosensitive drum, during the period between the timing A and the timing B. When the image forming apparatus completes activating all the loads at the timing B, the CPU 32 monitors the inlet current I2, and confirms whether the inlet current I2 is greater than the preset current limit Ilim. If the inlet current I2 is greater than the current limit Ilim as illustrated in FIG. 10B, the CPU 32 calculates a new fixing power Pf_down which has been decreased by the power corresponding to the differential current exceeding the current limit Ilim. In such a case, the fixing power Pf_down becomes the power Pf_max suppliable to the heater. If the power Pf_max suppliable to the heater is greater than the Ready power Pth (i.e., a first threshold power) during a warm-up period of the fixing unit, the image forming apparatus executes a mode (i.e., a first mode) for immediately starting the image forming process. On the other hand, if the power Pf_max suppliable to the heater is less than the Ready power Pth, the image forming apparatus executes a mode (i.e., a second mode) for starting the image forming process at the timing the detected temperature of the heater 100 has reached the threshold temperature which is lower than the target temperature T_print at which fixing process can be performed. The time from starting to supply power to the heater to starting the image forming process is shorter in the first mode as compared to the second mode. Further, conveyance of the recording material is controlled according to the timing the image forming process is started. For example, if the timing of the image forming process is delayed, the conveyance start timing of the recording material is synchronously delayed. Accordingly, the earlier the start timing of the image forming process, the earlier the timing at which the recording material reaches the secondary transfer portion and the fixing unit, so that the FPOT can be shortened.

According to the present exemplary embodiment, when the image forming process is started at the timing B illustrated in FIG. 10A, it indicates that the image forming process is immediately started in the first mode. However, it is not limited thereto, and the image forming process may be started after a predetermined time has elapsed from when the warm-up of the fixing unit 30 has started (i.e., power supply to the heater has started).

A control specification according to the present exemplary embodiment will be described below. If the power Pf_max suppliable to the heater is greater than the Ready power Pth (i.e. the threshold power) in the above-described warm-up control, the image forming apparatus immediately starts writing the image.

The case where the external option devices, i.e., the automatic document feeder 33, the image scanner 34, the sheet discharge option A 35, and the sheet discharge option B 36, are connected to the image forming apparatus will be described below. It is desirable for the external option devices to be standing by to immediately operate when there is a user operation or an operation instruction. In other words, it is desirable in view of usability that the operations of the external option devices are not synchronous with the image forming process. Therefore, when the CPU 32 monitors the inlet current I2 and confirms whether the inlet current I2 is greater than the preset current limit Ilim as described above, the power consumed by the option devices is not considered. If the external option devices then operate during the warm-up period of the fixing unit, there is a power shortage in the entire image forming apparatus. The CPU 32 thus limits the power to be supplied to the heater 100, so that the temperature of the heater 100 may not reach the temperature at which the fixing process can be performed within a scheduled time.

To solve such a problem, according to the present exemplary embodiment, when the external option devices are connected, a new Ready power Pth is calculated by adding the power necessary for the option devices to operate, to the Ready power Pth. When the external option devices are connected, the image forming apparatus determines the start timing of the image writing based on whether the power Pf_max suppliable to the heater is greater than the new Ready power Pth during the warm-up control.

A control process according to the present exemplary embodiment will be described below with reference to the flowchart illustrated in FIG. 11. In step S101, the CPU 32 starts supplying the predetermined power Pf to the fixing heater 100. In step S102, the CPU 32 drives the loads necessary for performing the image forming process, including activation of the fixing motor. In step S103, the CPU 32 measures the inlet current I2 and the heater current I1. In step S104, the CPU 32 compares the inlet current I2 (i.e., the total power) with the current limit Illim (i.e., the limit power). If the inlet current I2 exceeds the current limit Ilim (YES in step S104), the process proceeds to step S105. In step S105, the CPU 32 calculates the fixing power Pf_down which does not exceed the current limit Ilim. In step S106, the power supplied to the fixing heater 100 is changed to the power Pf_down. In step S107, the CPU 32 sets the value of Pf_down to the power Pf_max suppliable to the heater. On the other hand, if the inlet current I2 is less than the current limit Ilim (NO in step S104), the process proceeds to step S108. In step S108, the CPU 32 calculates the power Pf_max suppliable to the heater. In other words, the CPU 32 sets the power that can be supplied to the fixing heater 100 according to the total power to be supplied to the image forming apparatus for performing the image forming process. More specifically, if the total power exceeds the limit power, the power Pf_max suppliable to the heater is reduced as compared to the case where the total power does not exceed the limit power.

In step S109, the CPU 32 sets the predetermined Ready power Pth. The Ready power Pth is supplied to the heater 100 from when the image forming process is started to when the recording material 32 reaches the fixing nip portion N. The Ready power Pth thus allows the temperature of the fixing heater 100 to reach the target temperature T_print (° C.) at which the fixing process can be performed. In step S110, the CPU 32 confirms whether the image forming apparatus is connected to the external option devices as illustrated in FIGS. 8 and 9. If the CPU 32 determines that the external option device is connected (YES in step S110), the process proceeds to step S111. In step S111, the CPU 32 sums the power of the external option devices connected to the image forming apparatus when operating, and calculates the external option device power Po. In step S112, the CPU 32 adds the external options device power Po to the Ready power Pth and calculates the new Ready power Pth. If there is no external option device connected to the image forming apparatus (NO in step S110), the CPU 32 does not calculate the new Ready power Pth. In step S113, the CPU 32 compares the power Pf_max suppliable to the heater with the Ready power Pth. If the power Pf_max suppliable to the heater is greater than the Ready power Pth (YES in step S113), the process proceeds to step S115. In step S115, the CPU 32 immediately starts writing the image. On the other hand, if the power Pf_max suppliable to the heater is less than the Ready power Pth (NO in step S113), the process proceeds to step S114. In step S114, the CPU 32 compares the temperature of the fixing heater 100 with the threshold temperature T_print −30 (° C.). If the temperature of the fixing heater 100 reaches the threshold temperature T_print −30 (° C.) (YES in step S114), the process proceeds to step S115. In step S115, the CPU 32 starts writing the image. The CPU 32 continues to supply the power to the heater 100, and when the temperature of the fixing heater 100 reaches the target temperature T_print (° C.) at which the fixing process can be performed (YES in step S116), the warm-up of the fixing unit 30 ends.

As described above, according to the present exemplary embodiment, the first mode or the second mode is selected and executed according to the connection status of the external option devices to the image forming apparatus and the maximum power suppliable to the heater. As a result, an image forming apparatus can be provided which satisfies the fixing performance and is capable of shortening the FPOT even when the external option devices operate during the warm-up.

According to the first exemplary embodiment, the threshold power is changed according to the connection status of the external option devices to the image forming apparatus and the maximum power suppliable to the fixing heater. According to the second exemplary embodiment, a plurality of the threshold temperatures at which the image writing is started in the second mode according to the first exemplary embodiment is set based on the power Pf_max suppliable to the heater. Further, the Ready power Pdth for setting the threshold temperature is set according to the connection status of the external option devices to the image forming apparatus. According to the present exemplary embodiment, the differences from the first exemplary embodiment will be mainly described, and description on the common configurations will be omitted. The items which are not described below are thus similar to the first exemplary embodiment.

Figure 12:
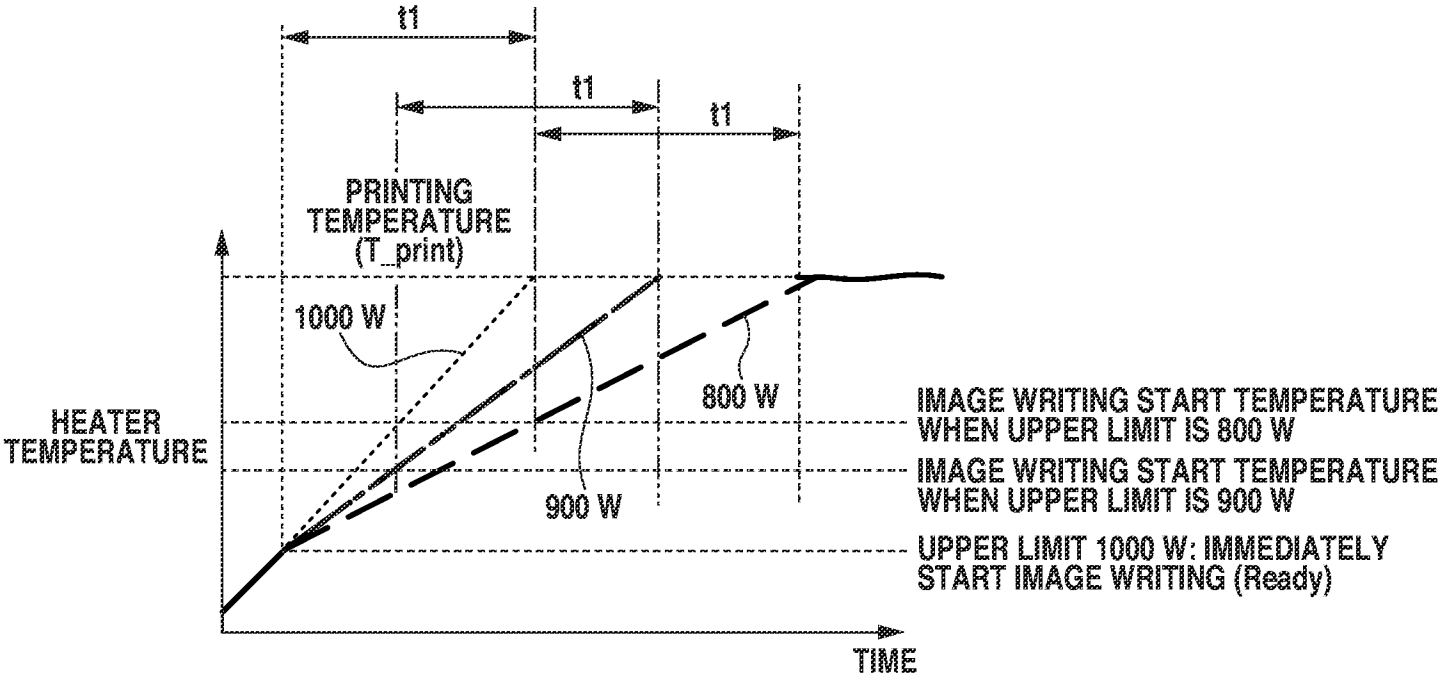
FIG. 12 illustrates warm-up control according to a second exemplary embodiment.

Warm-up control performed according to the second exemplary embodiment will be described below with reference to FIG. 12. FIG. 12 illustrates the temperature transition of the fixing heater 100 when power having the following upper limits is supplied to the fixing heater 100 and the warm-up is performed. The power in which the upper limit is 1000 W (i.e., a threshold power), 900 W (i.e., a second threshold power), and 800 W (i.e., a third threshold power) is supplied to the heating heater 100. Referring to FIG. 12, the time is indicated on a horizontal axis, and the temperature of the fixing heater 100 is indicated on a vertical axis of the graph. A time t1 is the time from when the warm-up has started to when the recording material has reached the fixing nip portion N. FIG. 12 illustrates that the speed at which the temperature of the fixing heater rises is different depending on the upper limit of the power to be supplied to the fixing heater 100. According to the present exemplary embodiment, if the upper limit of the power to be supplied to the fixing heater 100 is 1000 W, the temperature of the fixing heater 100 can rise to the target temperature T_print at which the fixing process can be performed within the time t1. Such a process can be realized even when the image writing is immediately started after starting the warm-up. However, if the upper limit of the power to be supplied to the fixing heater 100 is 900 W or 800 W, the temperature of the fixing heater 100 cannot rise to the target temperature T_print at which the fixing process can be performed within the time t1. As a result, the threshold temperature at which the image writing is started is set according to the power Pf_max suppliable to the heater. Further, if the external option device is connected to the image forming apparatus, the Ready power Pth which changes the temperature for starting the image writing is set according to the power necessary for operating the external option device.

Figure 13:
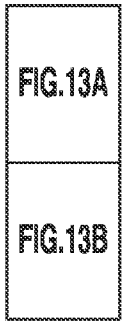
FIG. 13, which includes
Figure 13A:
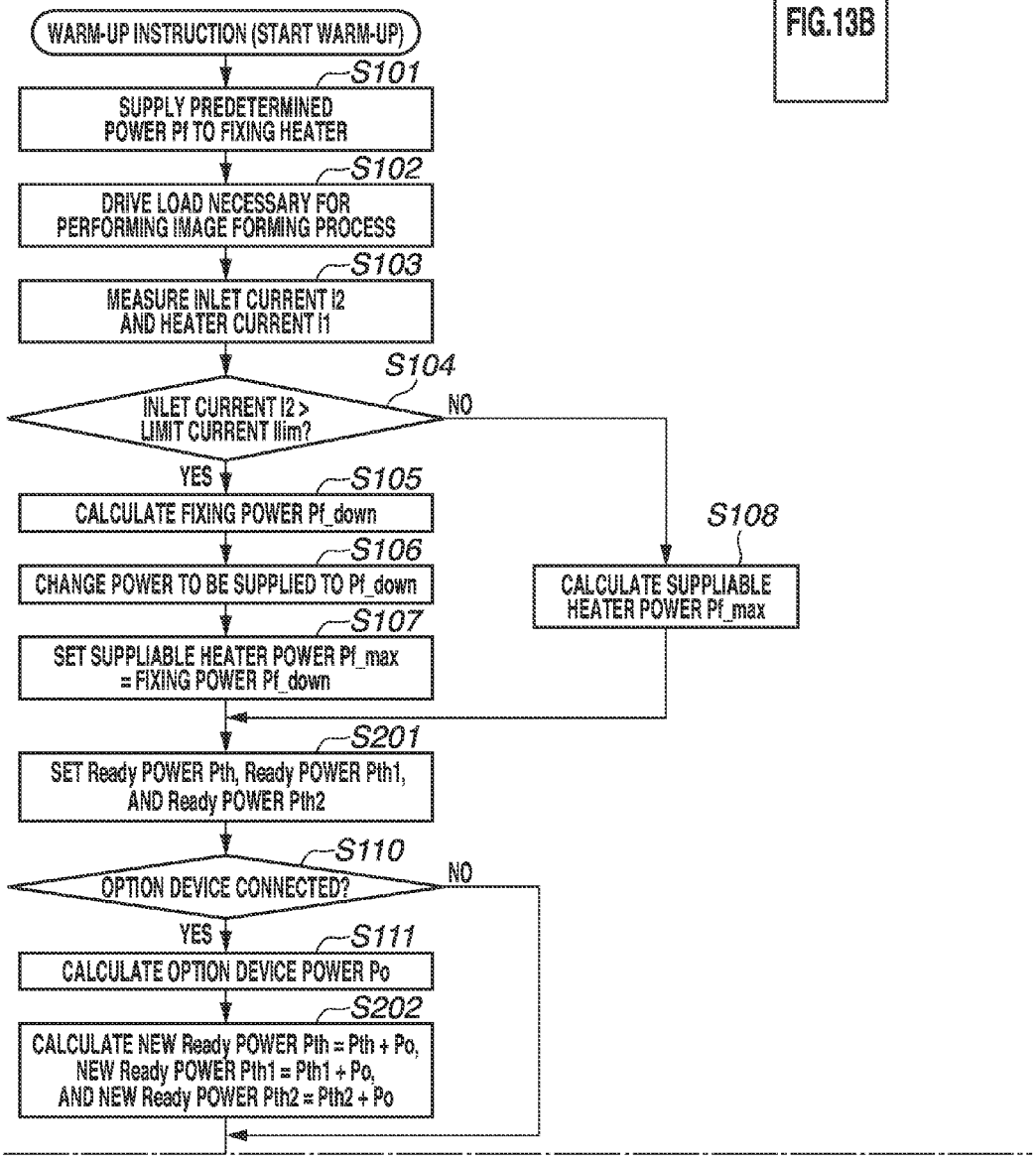
FIGS. 13A and 13B, shows a flowchart illustrating warm-up control according to the second exemplary embodiment.
Figure 13B:
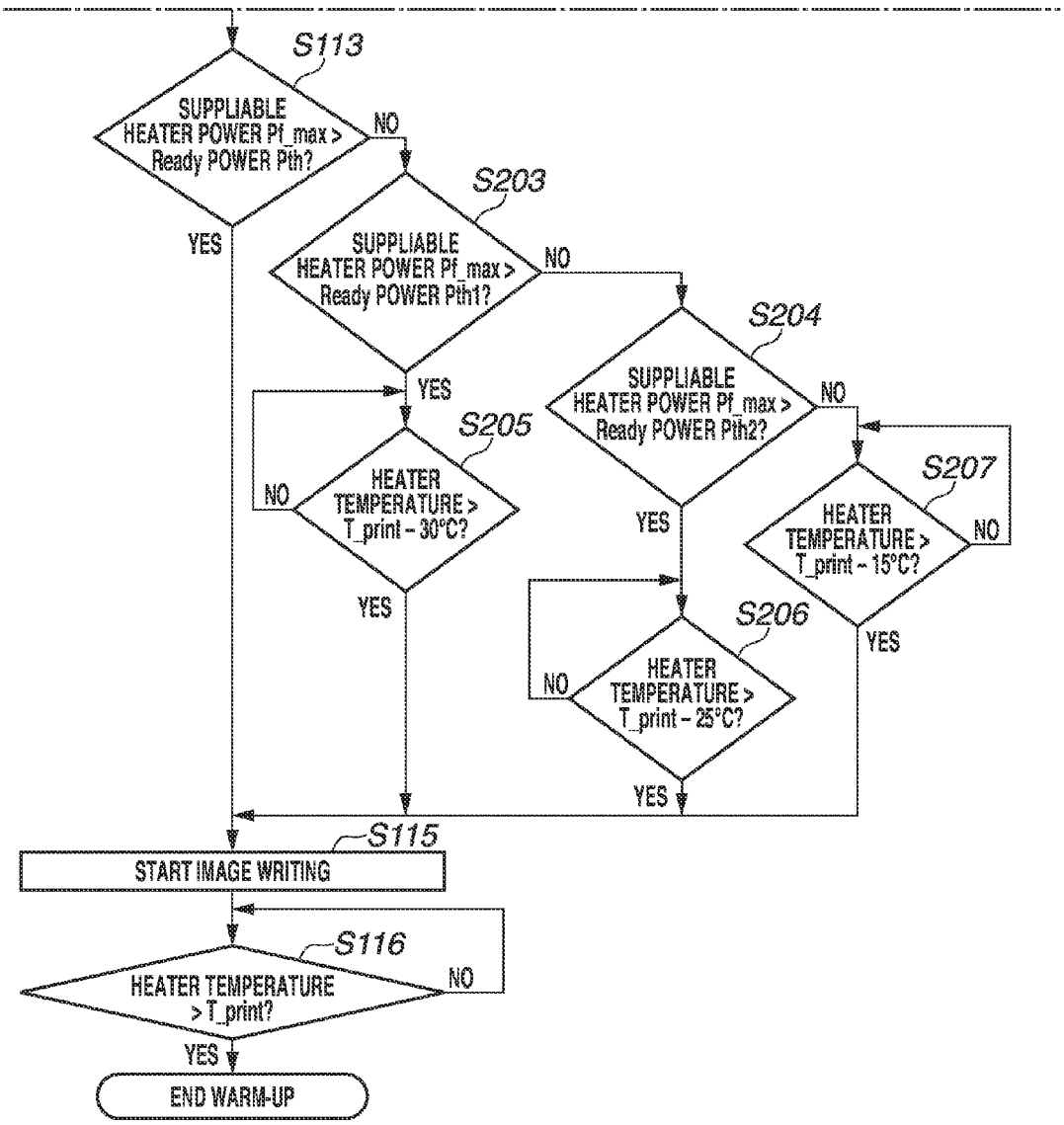

The control process according to the present exemplary embodiment will be described below with reference to the flowchart illustrated in FIG. 13, which includes FIGS. 13A and 13B. According to the present exemplary embodiment, the steps having similar functions as in the flowchart illustrated in FIG. 11 will be assigned the same reference numbers, and description thereof will be omitted. Step S201 corresponds to step S109 illustrated in FIG. 11. In other words, the CPU 32 sets predetermined Ready power Pth (i.e., the threshold power), Ready power Pdth1 (i.e., the second threshold power), and Ready power Pdth2 (i.e., the third threshold power). If the Ready power Pdth1 is continuously supplied from when the temperature of the fixing heater 100 reaches the threshold temperature T_print −30 (° C.) to when the recording material 21 reaches the fixing nip portion N, the temperature of the fixing heater 100 can be raised to the target temperature T_print (° C.) at which the fixing process can be performed. Further, if the Ready power Pdth2 is continuously supplied from when the temperature of the fixing heater 100 reaches the second threshold temperature T_print −25 (° C.) to when the recording material 21 reaches the fixing nip portion N, the temperature of the fixing heater 100 can be raised to the target temperature T_print (° C.).

Figure 11:
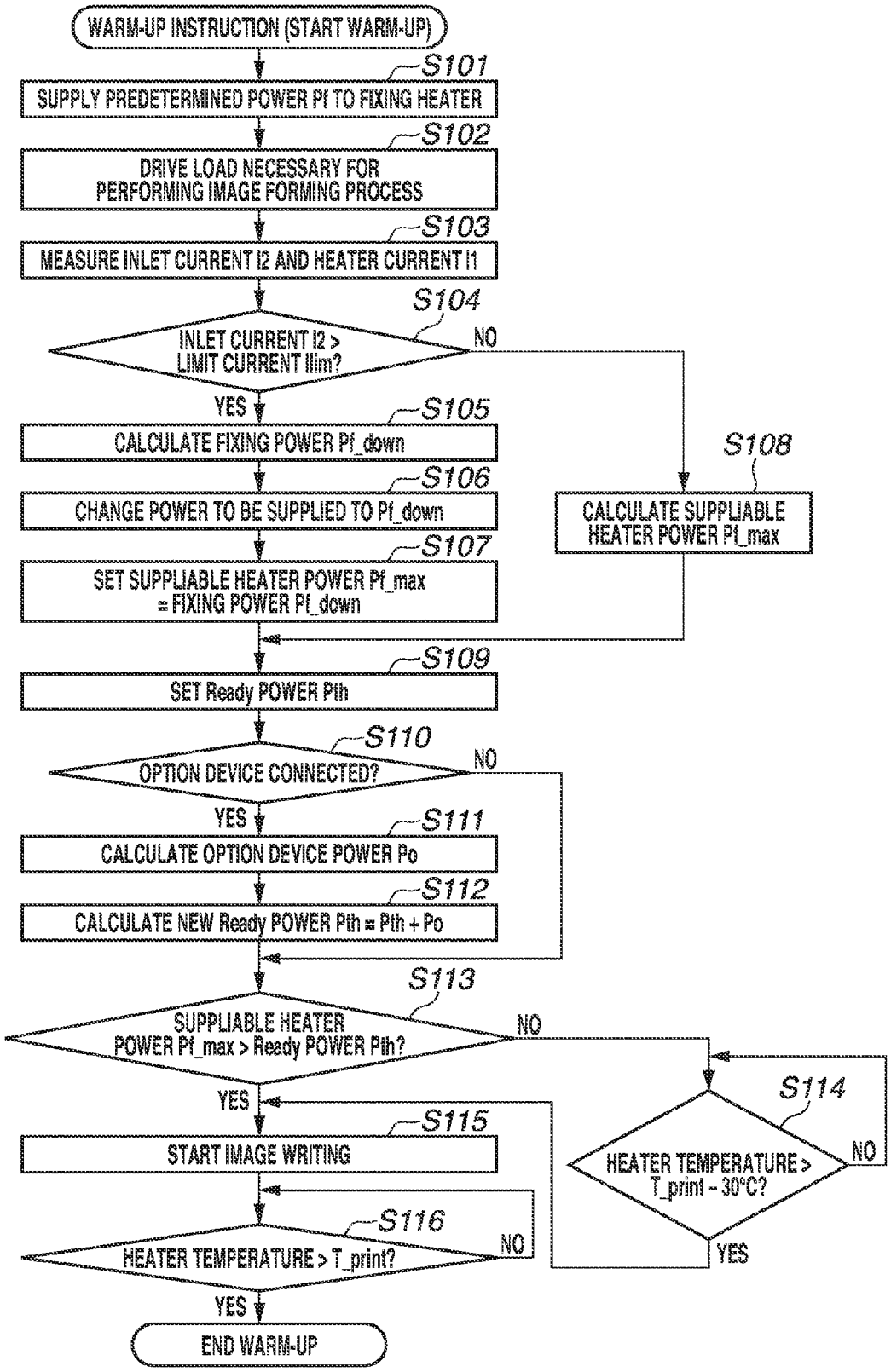
FIG. 11 is a flowchart illustrating warm-up control according to the first exemplary embodiment.

Step S202 corresponds to the control process performed in step S112 illustrated in FIG. 11. More specifically, in step S202, the CPU 32 adds the external option device power Po to the Ready power Pth, the Ready power Pth1, and the Ready power Pth2.

The processes of step S203 to step S207 are unique to the present exemplary embodiment. In step S113, the CPU 32 compares the power Pf_max suppliable to the heater with the Ready power Pth. If the power Pf_max suppliable to the heater is less than the Ready power Pth (NO in step S113), the CPU 32 shifts to the second mode in which the image writing is started according to the detected temperature of the fixing heater 100. The threshold temperature at which the image writing is started according to the power Pf_max suppliable to the heater is set in the processes performed in step S203 to step S207. In step S203, the CPU 32 compares the power Pf_max suppliable to the heater with the Ready power Pth1. If the power Pf_max suppliable to the heater is greater than the Ready power Pth1 (YES in step S203), the process proceeds to step S205. In step S205, the CPU 32 compares the temperature of the fixing heater 100 with T_print −30 (° C.). If the temperature of the fixing heater 100 reaches T_print −30 (° C.) (YES in step S205), the process proceeds to step S115, and the CPU 32 starts the image writing. If the power Pf_max suppliable to the heater is less than the Ready power Pth1 (NO in step S203), the process proceeds to step S204. In step S204, the CPU 32 compares the power Pf_max suppliable to the heater with the Ready power Pth2. If the power Pf_max suppliable to the heater is greater than the Ready power Pth2 (YES in step S204), the process proceeds to step S206. In step S206, the CPU 32 compares the temperature of the fixing heater 100 with T_print −25 (° C.). If the temperature of the fixing heater 100 reaches T_print −25 (° C.) (YES in step S206), the process proceeds to step S115, and the CPU 32 starts the image writing. On the other hand, if the power Pf_max suppliable to the heater is less than the Ready power Pth2 (NO in step S204), the process proceeds to step S207. In step S207, the CPU compares the temperature of the fixing heater with T_print −15 (° C.). If the temperature of the fixing heater reaches T_print −15 (° C.) (YES in step S207), the process proceeds to step S115, and the CPU 32 starts the image writing.

According to the present exemplary embodiment, the timing of starting the image forming process can be more finely set according to the heater suppliable power in the second mode as compared to the first exemplary embodiment. The FPOT can thus be further shortened.

The control sequence, the table, and the circuit configurations according to the above-described exemplary embodiments are not limited thereto.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

What is claimed is:

1. An image forming apparatus, to which an option device is connectable, for forming a toner image on a recording material, the image forming apparatus comprising:

an image forming unit configured to form an unfixed toner image on the recording material;

a fixing unit, including a heater, configured to fix the unfixed toner image on the recording material;

a temperature detection unit configured to detect a temperature of the fixing unit;

a power control unit configured to control power to be supplied to the heater so that a detected temperature by the temperature detection unit becomes a target temperature for enabling fixing the unfixed toner image, and to set a maximum power suppliable to the heater according to a total power to be supplied to the image forming apparatus;

a conveyance unit configured to convey the recording material to the fixing unit; and a conveyance control unit configured to control the conveyance unit;

a connection detecting unit configured to detect a connection status of the option device to the apparatus; and a comparison unit configured to compare the maximum power and a threshold power to find which is greater, the comparison unit setting a different value to the threshold power according to the connection status detected by the connection detecting unit, wherein in a case where the comparison unit finds that the maximum power is greater than the threshold power in a warm-up period of the fixing unit, the conveyance control unit controls the conveyance unit such that the conveyance unit conveys the recording material to the fixing unit, according to a time that has elapsed from a start of supplying power to the heater.

2. The image forming apparatus according to claim 1, wherein, in a case where the total power exceeds a limit power, the power control unit reduces the maximum power as compared to a case where the total power does not exceed the limit power.

3. The image forming apparatus according to claim 1, wherein the option device includes at least one of an automatic document feeder, an image scanner, and a sheet discharge option.

4. The image forming apparatus according to claim 1, wherein the threshold power in a case where the option device is connected to the image forming apparatus is set according to types of and a number of option devices connected to the image forming apparatus.

5. The image forming apparatus according to claim 1, wherein the fixing unit includes a cylindrical film.

6. The image forming apparatus according to claim 1, wherein the comparison unit sets a greater value to the threshold power when the connection detecting unit detects that the option device is connected to the image forming apparatus than a value when the connection detecting unit detects that the option device is not connected to the image forming apparatus.

7. An image forming apparatus, to which an option device is connectable, for forming a toner image on a recording material, the image forming apparatus comprising:

an image forming unit configured to form an unfixed toner image on the recording material;

a fixing unit, having a heater, configured to fix the unfixed toner image on the recording material;

a temperature detection unit configured to detect a temperature of the fixing unit;

a power control unit configured to control power to be supplied to the heater so that the detected temperature becomes a target temperature for enabling fixing the unfixed toner image, and to set a maximum power suppliable to the heater according to a total power to be supplied to the image forming apparatus;

a connection detecting unit configured to detect a connection status of the option device to the apparatus; and a comparison unit configured to compare the maximum power and a threshold power to find which is greater, the comparison unit setting a different value to the threshold power according to the connection status detected by the connection detecting unit, wherein in a case where the comparison unit finds that the maximum power is greater than the threshold power in a warm-up period of the fixing unit, the image forming unit starts to operate according to a time that has elapsed from a start of supplying power to the heater.

8. The image forming apparatus according to claim 7, wherein the power control unit reduces, in a case where the total power exceeds a limit power, the maximum power as compared to the case where the total power does not exceed the limit power.

9. The image forming apparatus according to claim 7, further comprising a conveyance unit configured to convey the recording material to the fixing unit, wherein a timing when the conveyance unit starts to convey the recording material to the fixing unit is determined according to a timing when the image forming unit starts to operate.

10. The image forming apparatus according to claim 7, wherein the option device includes at least one of an automatic document feeder, an image scanner, and a sheet discharge option.

11. The image forming apparatus according to claim 7, wherein the threshold power in a case where the option device is connected to the image forming apparatus is set according to types of and a number of option devices connected to the image forming apparatus.

12. The image forming apparatus according to claim 7, wherein the fixing unit includes a cylindrical film, and wherein the fixing unit fixes the toner image on the recording material using heat of the cylindrical film that has been heated by the heater.

13. The image forming apparatus according to claim 7, wherein the image forming unit includes a photosensitive drum and a developing roller, and wherein the operation of the image forming unit to be started is an operation to bring the developing roller into contact with the photosensitive drum.

14. The image forming apparatus according to claim 7, wherein the comparison unit sets a greater value to the threshold power when the connection detecting unit detects that the option device is connected to the image forming apparatus than a value when the connection detecting unit detects that the option device is not connected to the image forming apparatus.

* * * * *